US006047527A

United States Patent [19]

Pazdernik et al.

[11] Patent Number: 6,047,527

[45] Date of Patent: Apr. 11, 2000

[54] LOADING APPARATUS FOR BAG PACKAGING SYSTEM AND METHOD OF OPERATING THE SAME

[75] Inventors: Irvan Pazdernik, Alexandria; Jeff Lenarz, Garfield, both of Minn.

[73] Assignee: Douglas Machine Limited Liability Company, Alexandria, Minn.

[21] Appl. No.: 09/148,337

[22] Filed: Sep. 4, 1998

[51] Int. Cl.[7] ..... B65B 35/50

[52] U.S. Cl. ..... 53/447; 53/473; 53/535; 53/540; 53/247

[58] Field of Search ..... 53/245, 247, 258, 53/447, 473, 475, 535, 540, 542

[56] References Cited

U.S. PATENT DOCUMENTS

| | | | |
|---|---|---|---|
| 2,907,156 | 10/1959 | Anderson | 53/258 X |
| 2,909,018 | 10/1959 | Turner | 53/258 X |
| 3,425,184 | 2/1969 | Heliot | 53/247 X |
| 3,927,508 | 12/1975 | Campbell | 53/540 X |
| 4,141,193 | 2/1979 | Joa | 53/542 X |
| 4,524,566 | 6/1985 | Hauers et al. | 53/247 X |

*Primary Examiner*—Daniel B. Moon
*Attorney, Agent, or Firm*—Alan Kamrath Oppenheimer Wolff & Donnelly LLP

[57] ABSTRACT

A bag loading apparatus (26) of a packaging system (10) includes a platen (68) having a convex upper surface upon which layers of bags (16) are sequentially placed, with the platen (68) being lowered upon receipt of each layer, until a full stack is supported on the platen (68). The loading apparatus (26) also includes a pivotally mounted pusher plate (98) against which the layered bags (16) are arranged when supported on the platen (68). Furthermore, a shelf (58) is arranged above both the platen (68) and the pusher plate (98) and is preferably pivotally mounted about a common axis with the pusher plate (98). With a stack of bags (16) on the platen (68), the pusher plate (98) accelerates across the platen (68) to shift the bags (16) into an open container (28), with the bags (16) preferably assuming a generally wedge-shape to aid in the loading of the bags (16) into the container (28). The shelf (58) preferably moves in unison with the pusher plate (98) during the loading sequence and retreats following the loading process to, receive a first layer of bags (16) for a subsequent stack which is transferred to the platen (68) following a full return of the pusher plate (98) and shifting of the platen (68) to a raised position.

21 Claims, 2 Drawing Sheets

LOADING APPARATUS FOR BAG PACKAGING SYSTEM AND METHOD OF OPERATING THE SAME

BACKGROUND OF THE INVENTION

The present invention pertains to the art of packaging and, more particularly, to a method and apparatus for loading a stack of pliable bags into a container of an overall packaging system.

Various automated packaging arrangements wherein bags or the like are stacked in a desired array and then simultaneously loaded into a carton or other type of container have been proposed over the years. For instance, it is known in the art to provide a carrier for receiving and transporting bags which are individually dropped or otherwise directed into an open carton. This type of packaging system results in a packed carton having a considerable amount of wasted space between adjacent bags housed therein. Another known type of packaging system first stacks a predetermined number of bags upon a pallet or other supporting surface and then places a carton over the entire stack of bags. Thereafter, both the carton and pallet are inverted. Finally, the pallet is removed to arrive at the fully loaded carton. Such a packaging system can be fairly time consuming and often requires a considerable amount of operating space. In still another known type of packaging system, bags are collated upon a planar supporting surface and then shifted along the surface by a pusher plate into a carton. This kind of packaging system is considered to exhibit considerable advantages in efficiency and overall associated costs, yet can exhibit significant drawbacks depending on the particular system design and layout.

In developing a pliable bag packaging system, various parameters must be considered. For instance, the contents of bags can significantly impact the manner in which the bags can be loaded. For example, if the bags contain rather fragile food items, such as potato chips or the like which can be easily crushed, the packaging system must safeguard against damaging the stored product. In addition, it is desirable to minimize any wasted space in the packaged cartons in order to reduce potential shifting and damaging of the bags during subsequent transporting, while also reducing the amount of material needed to form the cartons. Of course, the smaller the size tolerance between the carton and the stacked bags, the more difficult it is to assure a rapid and reliable overall packaging system.

SUMMARY OF THE INVENTION

The present invention addresses these and other concerns in the structure and operation of a packaging system by providing an apparatus for loading pliable bags into a carton or other form of container, with the loading apparatus being designed to actually utilize the contents of the bags to aid in both efficiently supporting and loading of the bags. In particular, the present apparatus includes a shelf upon which an initial layer of bags is placed prior to being transferred to a support platen. The platen has a generally convexly curved upper surface upon which additional layers of the pliable bags are stacked, with the platen being lowered following receipt of each layer. When the platen is completely stacked, a pusher plate is shifted to move the stack of bags along the platen and into an open container.

In a preferred form of the invention, the bags are stacked upon one end portion of the platen and against the pusher plate. This arrangement tends to force the contents of the bags in an arched condition as the majority of the contents settles toward the pusher plate such that a generally wedge-shaped stack is formed. The pusher plate is preferably accelerated through an arcuate path to move the stack along the upper surface of the platen in order to maintain the wedge-shape of the stack which enhances the loading process.

It is thus an object of the present invention to provide an apparatus for enhancing the loading of bags into an open container.

It is another object of the present invention to reposition the contents of bags being stacked in order to create a generally wedge-shaped stack which can effectively aid in loading the bags into an open container.

It is a further object of the present invention to utilize a pivoting pusher plate to shift the stack of bags across the platen and into the container.

It is a still further object of the present invention to incorporate a shelf, adapted to be arranged above a bag supporting platen, for initially receiving a first layer of bags to be transferred to the platen.

Additional objects, features and advantages of the method and apparatus for loading bags in accordance with the present invention will become more readily apparent from the following detailed description of the preferred embodiment thereof when taken in conjunction with the drawings wherein like reference numerals refer to corresponding parts in the several views.

Figure 1:
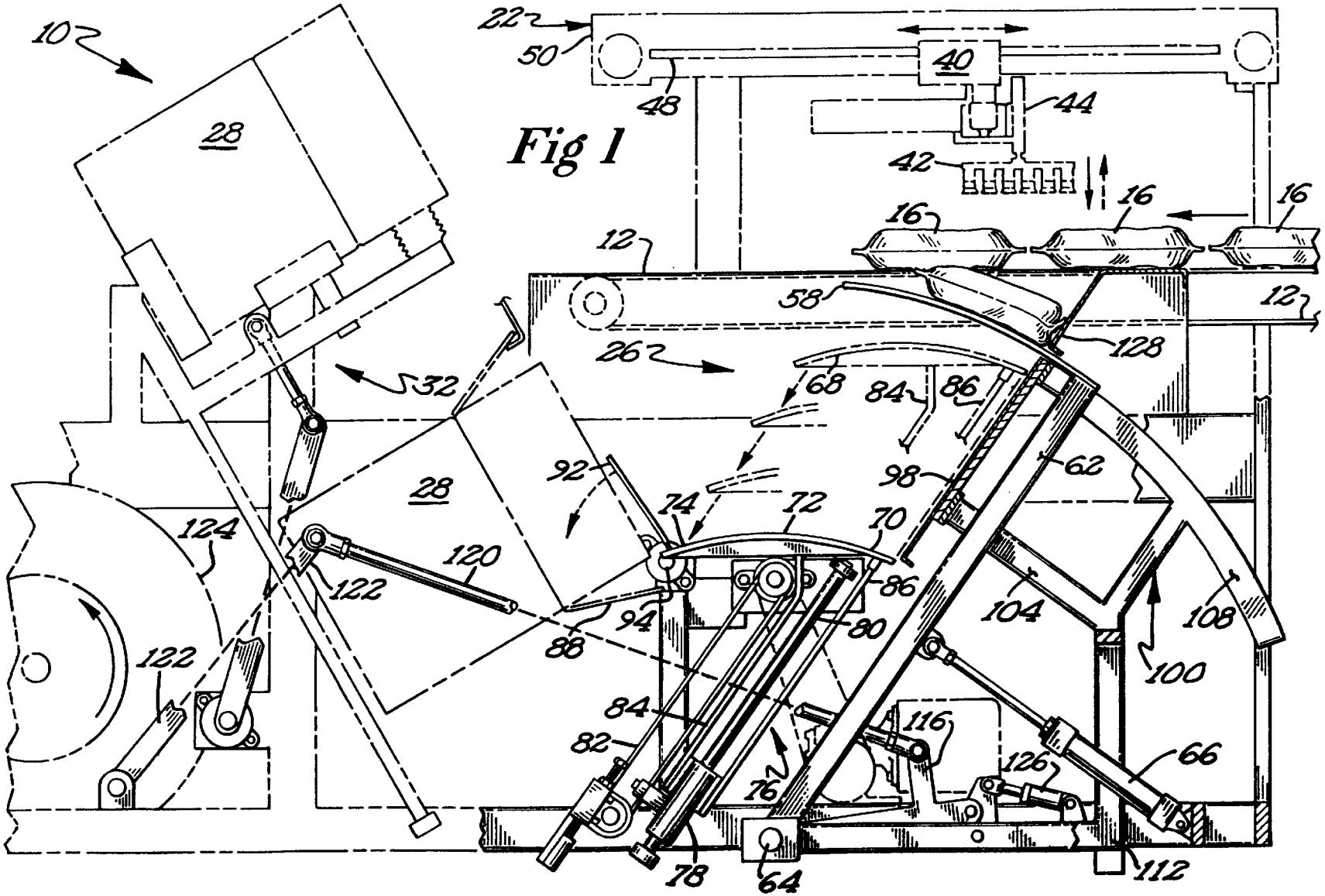
FIG. 1 is a partial plan side view of a packaging system incorporating the loading apparatus of the invention.

It should be noted that all figures are drawn for ease of explanation of the basic teachings of the present invention only; extension of the figures with respect to number, position, relationship and dimension of the parts to form the preferred embodiment will be within the skill of the art after the following teachings of the present invention have been read and understood. Further, the exact dimensions and dimensional proportions to conform to specific force, weight, strength and similar requirements will likewise be within the skill of the art after the following teachings of the present invention have been read and understood.

Furthermore, when the terms "top", "bottom", "first", "second", "upper", "lower", "upwardly", "downwardly", "vertical", "horizontal", and similar terms are used herein, it should be understood that these terms have reference only to the structure shown in the drawings as it would appear to a person viewing the drawings and are utilized only to facilitate describing the invention.

DETAILED DESCRIPTION OF THE PREFERRED EMBODIMENT

A system for mechanically processing pliable bags according to the preferred teachings of the present invention is shown in the drawings and generally indicated at 10. In general, packaging system 10 includes a conveyor 12 for transporting pre-filled bags 16 to a position below a transfer mechanism 22. Although the contents of bags 16 can vary in accordance with the invention, in the most preferred form, bags 16 are pliable and contain fragile food items, such as various types of chips. Transfer mechanism 22 systematically picks up and deposits bags 16 unto a loading apparatus 26 until a predetermined array of bags are placed in a stack which is then loaded into a container 28, such as a foldable, cardboard carton. Thereafter, carton 28 is lifted by a hoisting device 32 for delivery to a subsequent processing stage of packaging system 10. The present invention is particularly directed to the structure and operation of loading apparatus 26. However, for the sake of completeness, the general manner in which the overall packaging system 10 operates in conjunction with loading apparatus 26 will be discussed more fully below.

In the preferred embodiment shown, transfer mechanism 22 includes a pick and place unit 40 incorporating a pneumatic suction head 42 which can be raised and lowered by means of a linear actuator 44. Suction head 42 is mounted for linear movement in a first direction upon a rail 48 that is carried by a header support 50. In addition, although not clearly shown, suction head 42 is also movable in a direction substantially perpendicular to the first direction, i.e., into and out of the page as viewed in FIG. 1, through the use of a similar rail arrangement. In general, the structure and operation of transfer mechanism 22 is known in the art, does not form part of the present invention and will not be further discussed here.

For purposes of the present invention, mechanism 22 functions to transfer bags 16 from atop conveyor 12 to loading apparatus 26. More specifically, a first layer of bags 16 are placed upon a shelf 58 of loading apparatus 26. In the most preferred form of the invention, each layer of bags 16 defines a row including from 2–4 adjacent bags 16, although a single bag 16 could define each layer. As shown, shelf 58 preferably has a curvilinear upper surface and projects from an upper portion of a frame 62 which is mounted for pivotal movement about a pivot shaft 64. A linear actuator 66 is connected to an intermediate section of frame 62. With this arrangement, extension and retraction of linear actuator 66 causes pivoting of frame 62 and arcuate movement of shelf 58.

Arranged below shelf 58 is a platen 68 which has a convexly curved upper surface defined by a first end portion 70, a central apex portion 72 and a second end portion 74. Platen 68 is adapted to be raised and lowered through the use of a lifting device 76. Although lifting device 76 can take various forms without departing from the invention, in the preferred form of the invention, lifting device 76 includes a sleeve 78 that is slidably mounted about a fixed guide rod 80. Guide rod 80 is attached to an endless drive element 82 which is adapted to be selectively driven to raise or lower platen 68. As shown, lifting device 76 also includes a pair of stabilizing rods 84 and 86 which extend between and are fixedly secured to both sleeve 78 and platen 68.

In accordance with the invention, platen 68 can assume a lowermost position as shown in solid lines in FIG. 1, a fully raised position shown in phantom just below shelf 58 and a number of discrete, intermediate positions depending on the number of layers of bags 16 to be placed thereon. Guide rod 80 extends at an acute angle to the vertical, preferably in the order of 35°–40°, such that platen 68 is shifted closer to container 28 when lowered. When in its lowermost position, platen 68 is positioned directly adjacent a flap 88 of container 28. During a loading process, flap 88 is adapted to be trapped to assure a fully open condition for container 28 by the pivoting of a trap plate 92 about an axis defined by a pivot pin 94.

Loading apparatus 26 also includes a pusher plate 98 which, during the loading of bags 16 upon platen 68, assumes the position shown in FIG. 1. More specifically, pusher plate 98 is positioned just outward of first end portion 70 of platen 68. Furthermore, pusher plate 98 extends substantially parallel to guide rod 80, i.e., at approximately 35°–40° to the vertical such that platen 68 remains directly adjacent pusher plate 98 throughout its range of motion. Pusher plate 98 is carried by a frame 100. In the most preferred form of the invention, frame 100 includes support arm section 104, an upper leg 108 which is curved in conformance with shelf 58, and a generally L-shaped frame section 112. Frame section 112 is preferably pivotally mounted about a common axis, defined by pivot shaft 64, with frame 62. Frame 100 is pivoted in unison with a lever 116 to which is attached a control rod 120. Control rod 120 is, in turn, rotatably attached to a link 122 associated with a cam driver 124.

The operating of cam driver 124 is known in the art and does not constitute an aspect of the present invention. However, in general, rotation of cam driver 124 causes movement of a follower (not shown) which causes link 122 to oscillate. Movement of link 122 results in the pivoting of pusher plate 98 relative to platen 68 through control rod 120, link 122 and frame 100. An adjustment unit 126 can be provided to finely adjust the stroke of frame 100 during a loading operation.

Figure 2:
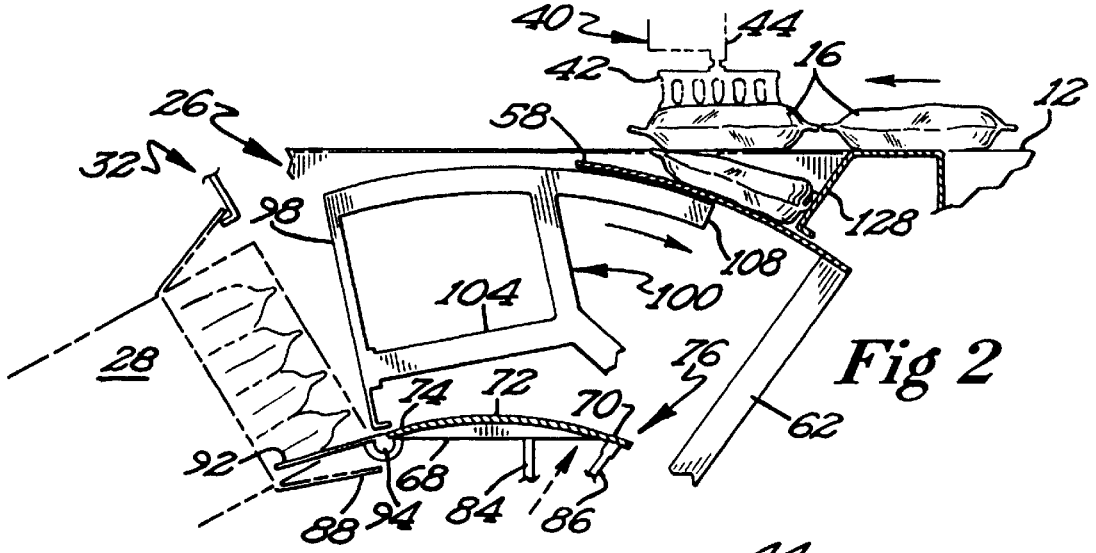
FIG. 2 illustrates the apparatus in an operating condition following the completion of a loading operation.

The manner in which bags are stacked upon platen 68 and then loaded into container 28 by loading apparatus 26 in accordance with the present invention will now be described. Following the loading of a prior array of bags 16 from atop platen 68, frame 62 is pivoted away from container 28 and assumes the position shown in FIG. 2. Transfer mechanism 22 then arranges one layer of bags 16 atop shelf 58, while frame 100 is pivoted from the position shown in FIG. 2 to the position shown in FIG. 1. Thereafter, platen 68 is shifted to its fully raised position. In this position, pusher plate 98 is arranged at the first end portion 70 of platen 68. Next, shelf 58 is moved from above platen 68 by the further retraction of actuator 66. This movement forces the layer of bags 16 on shelf 58 to engage an abutment plate 128, beneath which shelf 58 shifts, such that the first layer of bags 16 are caused to drop onto platen 68. With platen 68 fully raised, the first layer of bags 16 are dropped only a short distance so as to prevent any damage thereto.

Figure 3:
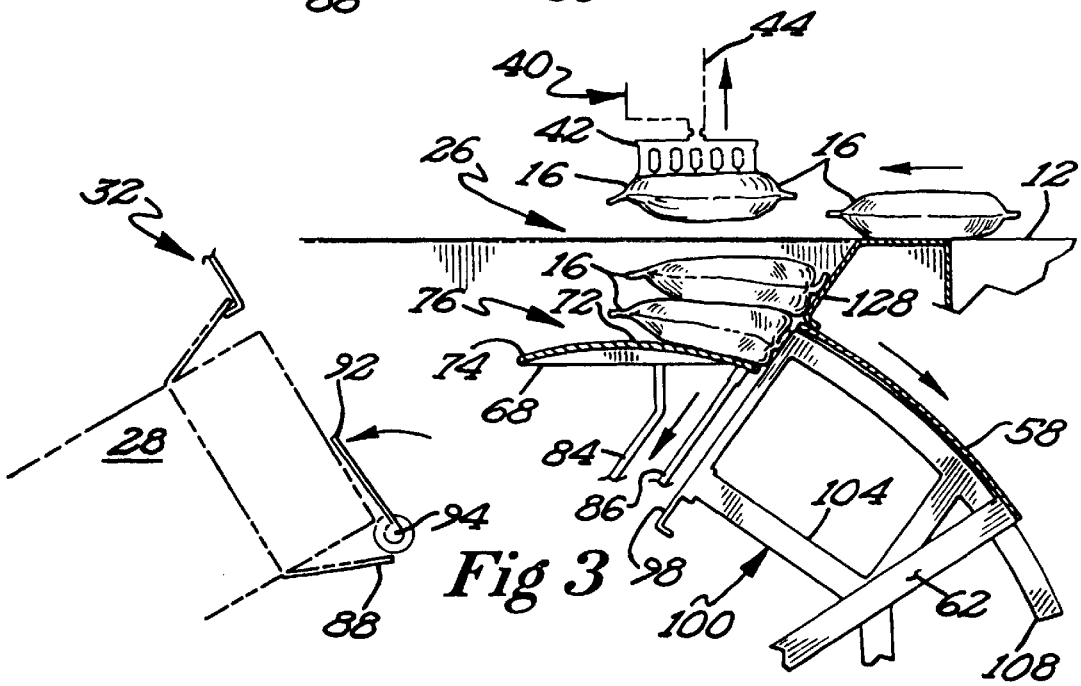
FIG. 3 illustrates the apparatus in an intermediate operating condition.

Next, platen 68 is lowered a predetermined increment by lifting device 76. In the most preferred form of the invention, platen 68 is adapted to receive four layers of bags 16 such that platen 68 is to be lowered from its fully raised to its lowermost position in three incremental stages. In any event, platen 68 is lowered following the placement of each layer thereon. FIG. 3 best illustrates the shifting of platen 68 following receipt of the first layer of bags 16, with the second layer being completed by transfer mechanism 22. This operation continues until a requisite number of layers is supported upon platen 68. Again, in the most preferred form of the invention, four layers of bags 16 are stacked upon platen 68.

Figure 4:
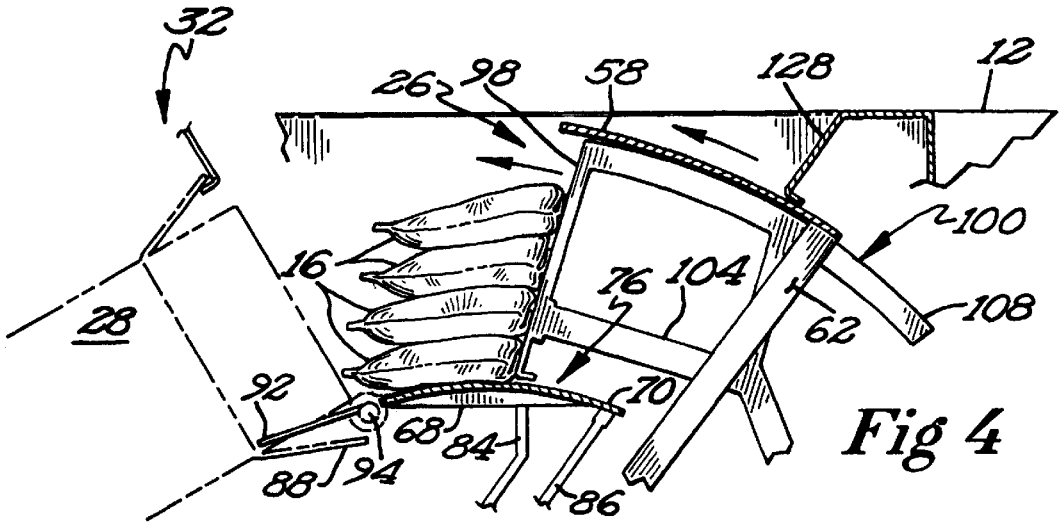
FIG. 4 illustrates the apparatus in an operating position just prior to a final loading condition.

At this point, it should be noted that at least a majority of each bag 16 is supported by the first end portion 70 of platen 68. Due to the curvature of the upper surface of platen 68, the contents of the bags 16 are generally forced to assume an arched configuration, with a majority of the contents settling toward pusher plate 98. Therefore the bags tend to somewhat lean against pusher plate 98 and this relationship is maintained for each layer since platen 68 is lowered in a plane which is substantially parallel to pusher plate 98. In any event, this arrangement advantageously promotes a wedge or funnel shape formation of the bags 16 as perhaps best shown in FIGS. 3 and 4. Once platen 68 is fully lowered, frames 62 and 100 are caused to simultaneously pivot about shaft 64 for loading of bags 16 in container 28. At this time, trap plate 92 is also caused to pivot in order to maintain flap 88 in a fully open condition which creates a loading chamber defined by platen 68, pusher plate 98 and the sides relative to which platen 68 and pusher plate 98 move and which contains bags 16 in their pack pattern.

The movement of pusher plate 98 above platen 68 results in the shifting of bags 16 from first end portion 70, across apex portion 72, along second end portion 74 and into container 28. While shifting the bags 16 toward container 28, it is desirable to maintain the wedge configuration of the bags 16 to enhance the loading of the bags 16 into container 28. This preferred feature of the present invention is aided by pusher plate 98 being continually accelerated while forcing bags 16 across the upper surface of platen 68. However, pusher plate 98 stops short of container 28 to prevent a high pressure rise at container 28 which could result in bags 16 blowing out of the established pack pattern. In addition, pusher plate 98 is caused to travel on a radius substantially equal to an associated radius of platen 68.

At this point, it should be recognized that container 28 preferably extends at an angle substantially tangent to second end portion 74 during loading. With this arrangement, the stacked bags 16 can be efficiently shifted into container 28, from a generally horizontal condition upon loading apparatus 26 to a more vertical condition within container 28, without being displaced from the desired pack pattern. Of course, this efficient operation is enhanced by the arrangement of trap plate 92 which essentially acts as an extension of platen 68 during loading of bag 16 into container 28.

Once the stack of bags 16 is loaded into container 28, pusher plate 98 starts to pivot back to the position shown in FIG. 3. Once pusher plate 98 has returned approximately 10°, trap plate 92 opens to allow the loaded container 28 to be removed by hoisting device 32 and replaced by a new, empty container 28. However, shelf 58 does not fully retract but rather, as indicated above, assumes the position of FIG. 2 in order to initiate the next loading cycle so that the production line can continue at a desired rate without stopping during the loading process. Once pusher plate 98 is fully returned, platen 68 is fully raised. Again, shelf 58 retracts after a new layer of bags 16 is placed thereon to allow the new layer of bags 16 to drop onto platen 68, followed by a lowering of platen 68 and a repeat of the above-described operation cycle.

Based on the above, it should be readily apparent that loading apparatus 26 incorporates various structural features which combine in a synergistic manner to enhance the efficient loading of bags 16 onto platen 68, as well as into container 28. More particularly, due to the curative of the upper surface of platen 68 and the arrangement of pusher plate 98, a stack of bags 16 can be caused to assume a desirable pack pattern and shape for loading. In addition, the manner in which the angled pusher plate 98 is pivoted across the upper surface of the platen 68 enables the pack pattern to be maintained throughout the loading sequence for the bags 16. This loading operation is further enhanced by the arrangement of trap plate 92 and the angling of container 28.

Now that the basic teachings of loading apparatus 26 according to the present invention have been set forth, it should also be apparent that other variations will be obvious to persons skilled in the art. Thus the invention disclosed herein may be embodied in other specific forms without departing from the spirit or general characteristics thereof, some of which forms have been indicated, and the embodiment described herein should be considered in all respects illustrative and not restrictive. The scope of the invention is to be indicated by the appended claims, rather than by the foregoing description, and all changes which come within the meaning and range of equivalents of the claims are intended to be embraced therein.

We claim:

1. In a packaging system wherein pliable bags are stacked prior to being simultaneously loaded into a container, an apparatus for loading the pliable bags into a container comprising, in combination: a platen including an upper surface adapted to support a stack of bags which are placed thereon in layers, with the upper surface being convexly curved so as to define a raised apex portion arranged adjacent a first end portion; and a mechanism for simultaneously pushing the stack of bags supported upon the platen into an open container, with the pushing mechanism being adapted to initially engage the stack of bags at the first end portion of the platen with the stack of bass leaning against the pushing mechanism when the layers are placed upon the platen and adapted to extend above the platen in order to shift the bags across the apex portion and into the container.

2. The loading apparatus of claim 1 wherein the pushing mechanism includes a pusher plate adapted to abut the stack of bags when the layers are placed on the platen, with the pusher plate being angled with respect to a vertical when the layers are placed on the platen and mounted for pivotal movement relative to the platen.

3. The loading apparatus of claim 2 wherein the convexly curved upper surface of the platen has an associated radius and the pusher plate is mounted for pivotal movement about a stationary pivot axis along a radius which is substantially equal to the radius of the upper surface.

4. The loading apparatus of claim 1 wherein the upper surface of the platen also includes a second end portion, with the apex portion being arranged between the first and second end portions, with the loading apparatus further comprising, in combination: means for arranging the container to extend at an angle substantially tangent to the second end portion of the platen.

5. The loading apparatus of claim 1 wherein the upper surface where the layers are placed is curved to force the contents of the bag in an arched condition to form a wedge-shaped stack of bags.

6. In a packaging system wherein pliable bags are stacked prior to being simultaneously loaded into a container, an apparatus for loading the pliable bags into a container comprising, in combination: a platen including an upper surface adapted to support a stack of bags which are placed thereon in layers, with the upper surface being convexly curved so as to define an apex portion arranged adjacent a first end portion; a mechanism for vertically shifting the platen, in stages, from an initial raised position to a final lowered position upon layering of the bags on the platen; and a mechanism for simultaneously pushing the stack of bags supported upon the platen into an open container, with the pushing mechanism being adapted to initially engage the stack of bags at the first end portion of the platen and extend above the platen in order to shift the bags across the apex portion and into the container.

7. The loading apparatus of claim 6 wherein the shifting mechanism raises and lowers the platen in a plane that extends at an acute angle to vertical such that the platen is simultaneously shifted toward the container upon moving from the raised position to the lowered position.

8. The loading apparatus of claim 7 wherein the pushing mechanism includes a pusher plate adapted to abut the stack of bags, with the pusher plate extending at an acute angle to vertical as the array of bags are placed on the platen, with the acute angle being substantially parallel to the plane in which the platen is shifted by the shifting mechanism.

9. The loading apparatus of claim 8 wherein the acute angle is in the range of approximately 35°–40°.

10. In a packaging system wherein pliable bags are stacked prior to being simultaneously loaded into a container, an apparatus for loading the pliable bags into a container comprising in combination: a platen including an upper surface adapted to support a stack of bags which are placed thereon in layers, with the upper surface being convexly curved so as to define an apex portion arranged adjacent a first end portion; and a mechanism for simultaneously pushing the stack of bags supported upon the platen into an open container, with the pushing mechanism being adapted to initially engage the stack of bags at the first end portion of the platen and extend above the platen in order to shift the bags across the apex portion and into the container; wherein the pushing mechanism includes a pusher plate adapted to abut the stack of bags directly adjacent the first end portion of the platen, with the loading apparatus further comprising, in combination: a shelf positioned above the platen, with the shelf being pivotally mounted for movement relative to both the platen and the pusher plate.

11. The loading apparatus of claim 10 wherein the pusher plate is also pivotally mounted for movement relative to at least the platen, with the pusher plate and the shelf being pivotable about a common axis.

12. The loading apparatus of claim 11 wherein the shelf is spaced radially from the common axis a distance greater than the pusher plate.

13. A method of loading pliable bags into a container comprising: transporting bags toward a loading apparatus; creating a stack of bags upon a first end portion of a curvilinear upper surface of a platen of the loading apparatus by sequentially positioning layers of the bags on the platen; lowering the platen a predetermined distance following the placement of each layer of bags upon the platen; and causing a pusher plate to shift the stack of bags from the first end portion and over an apex portion to load the bass into an open container.

14. A method of loading pliable bags into a container comprising: transporting bags toward a loading apparatus; creating a stack of bags upon a first end portion of a curvilinear upper surface of a platen of the loading apparatus by sequentially positioning layers of the bags on the platen; causing a pusher plate to shift the stack of bags from the first end portion and over an apex portion to load the bags into an open container; and accelerating the pusher plate from the first end portion across the apex portion of the platen.

15. A method of loading pliable bags into a container comprising: transporting bags toward a loading apparatus; creating a stack of bags upon a first end portion of a curvilinear upper surface of a platen of the loading apparatus by sequentially positioning layers of the bags on the platen; causing a pusher plate to shift the stack of bags from the first end portion and over a raised apex portion to load the bags into an open container; and leaning the layers of bags against the pusher plate while creating the stack of bags on the first end portion of the platen.

16. The method according to claim 15 further comprising: pivoting the pusher plate through an arcuate path to shift the stack of bags into the open container.

17. The method according to claim 16 further comprising: pivoting a shelf, arranged above the stack of bags on the platen, in unison with the pusher plate as the stack of bags is shifted toward the container.

18. The method according to claim 17 further comprising: pivoting both the pusher plate and the shelf about a common axis.

19. The method of claim 15 wherein the stack is created on an arched first end portion to force the contents of the bag in an arched condition to form a wedge-shaped stack of bags.

20. A method of loading pliable bags into a container comprising: transporting bags toward a loading apparatus; creating a stack of bags upon a first end portion of a curvilinear upper surface of a platen of the loading apparatus by sequentially positioning layers of the bags on the platen; causing a pusher plate to shift the stack of bags from the first end portion and over an apex portion to load the bags into an open container; initially arranging a first layer of the bags upon a shelf located above the platen; and transferring the first layer of bags to the platen from the shelf.

21. The method according to claim 20 further comprising: positioning each of the layers of bags, following the first layer of bags, directly upon a preceding layer of bags placed upon the platen.

* * * * *

UNITED STATES PATENT AND TRADEMARK OFFICE

CERTIFICATE OF CORRECTION

PATENT NO. : 6,047,527

DATED : April 11, 2000

INVENTOR(S) : Pazdernik et al.

It is certified that error appears in the above-indentified patent and that said Letters Patent is hereby corrected as shown below:

Cover Page, Item [56], add the following under U.S. PATENT DOCUMENTS referenced:

| | | | |
|---|---|---|---|
| -- | 2,655,271 | 10/1953 | Cole et al. |
| | 4,492,070 | 01/1985 | Morse et al. |
| | 4,781,011 | 11/1988 | Prakken. |
| | 4,864,801 | 09/1989 | Fallas. |
| | 5,022,218 | 06/1991 | Prakken. |
| | 5,279,099 | 01/1994 | Goodman et al. |
| | 5,410,859 | 05/1995 | Kresak et al. |
| | 5,502,948 | 04/1996 | Tanaka. |
| | 5,515,664 | 05/1996 | Tanaka et al. |
| | 5,548,945 | 08/1996 | Nippes. |
| | 5,615,536 | 04/1997 | Tanaka. |
| | 5,642,603 | 07/1997 | Tanaka. --. |

UNITED STATES PATENT AND TRADEMARK OFFICE

CERTIFICATE OF CORRECTION

PATENT NO. : 6,047,527
DATED : April 11, 2000
INVENTOR(S) : Pazdernik et al

It is certified that error appears in the above-indentified patent and that said Letters Patent is hereby corrected as shown below:

Cover Page, Item [57], line 18 of the Abstract, cancel "to," and substitute therefor -- to --.

Column 6, line 23, cancel "bass" and substitute therefor -- bags --.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*